United States Patent [19]

Lee

[11] 4,136,652

[45] Jan. 30, 1979

[54] FUEL DELIVERY SYSTEM

[75] Inventor: Wenpo Lee, Wolfsburg, Fed. Rep. of Germany

[73] Assignee: Volkswagenwerk Aktiengesellschaft, Wolfburg, Fed. Rep. of Germany

[21] Appl. No.: 733,804

[22] Filed: Oct. 19, 1976

[30] Foreign Application Priority Data

Nov. 3, 1975 [DE] Fed. Rep. of Germany ..... 2549104

[51] Int. Cl.[2] ..... F02M 59/00

[52] U.S. Cl. ..... 123/136

[58] Field of Search ... 123/139 AW, 139 E, 139 AV, 123/1 A, 32 EA, 32 AE, 136

[56] References Cited

U.S. PATENT DOCUMENTS

| | | | |
|---|---|---|---|
| 2,893,712 | 7/1959 | Huse | 123/139 AW |
| 2,948,273 | 8/1960 | Suttle | 123/32 EA |
| 2,957,466 | 10/1960 | Elliott | 123/139 AW |
| 2,957,467 | 10/1960 | Ball | 123/139 AW |
| 3,533,381 | 10/1970 | Schmid et al. | 123/32 EA |
| 3,724,435 | 4/1973 | Bier | 123/32 AE X |
| 3,749,376 | 7/1973 | Alm et al. | 123/1 A |
| 3,774,580 | 11/1973 | McGavic | 123/32 EA |
| 3,842,813 | 10/1974 | Eckert | 123/139 AW |
| 4,024,848 | 5/1977 | Lee | 123/1 A |

*Primary Examiner*—Charles J. Myhre
*Assistant Examiner*—Tony M. Argenbright
*Attorney, Agent, or Firm*—Brumbaugh, Graves, Donohue & Raymond

[57] ABSTRACT

A fuel delivery system for an engine operated with a gasoline/alcohol fuel mixture in which a fuel pump delivers fuel from a fuel tank to a fuel feed device on the engine. According to the invention the fuel pump is immersed within the fuel in the fuel tank and a fuel return line is connected to the pressure side of the pump for returning fuel directly to the fuel tank.

3 Claims, 1 Drawing Figure

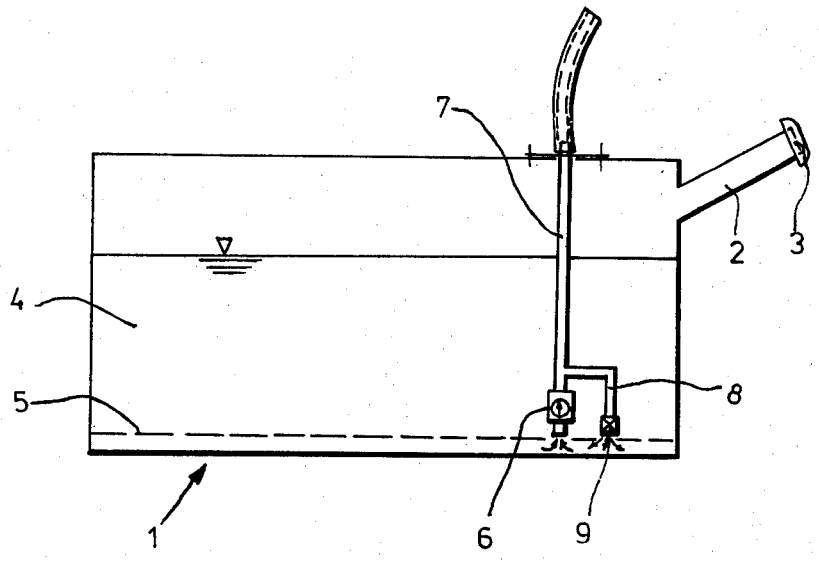
7
2
3
4
5
8
1
6
9

FUEL DELIVERY SYSTEM

BACKGROUND OF THE INVENTION

The invention concerns a fuel delivery system for an internal combustion engine operated with a gasoline/alcohol mixture as fuel. The system includes a fuel pump for supplying fuel under pressure from a fuel tank to the fuel feed device of the engine.

It is known to operate internal combustion engines, in particular automobile engines, with a gasoline/alcohol mixture in place of gasoline. Mixtures of gasoline and methanol or ethanol have been used for example. When such a fuel mixture is employed, it is found that in the presence of water, and especially at low temperatures, the components of the fuel mixture may disassociate or separate. Such a separation deleteriously affects the operating behavior of the internal combustion engine because the fuel feed device of the engine, such as the carburetor or the fuel injection device, is adjusted for a prescribed fuel composition and if this composition is changed, the feed device is no longer able to produce a fuelair mixture corresponding to the prevailing operating conditions of the engine.

The introduction of water in liquid or vapor state into the fuel tank cannot always be avoided with certainty since it may occur during filling of the automobile tank or even during operation by way of the vent line. Therefore, separation of the fuel mixture entailing the consequences described above may occur.

Therefore, it is an object of the present invention to provide a fuel delivery system which is operative to supply a uniform gasoline/alcohol mixture to an internal combustion engine and to prevent as much as possible the separation, possibly caused by the presence of water, of the gasoline/alcohol mixture in the fuel tank.

SUMMARY OF THE INVENTION

This object, as well as other objects which will become apparent in the discussion that follows, are achieved, in accordance with the present invention, by connecting a fuel return line to the pressure side of the pump for returning fuel directly to the fuel tank.

With the fuel delivery system according to the invention, a certain quantity of fuel is continously returned to the fuel tank; that is to say, as long as the fuel pump is in operation. This recycling of fuel effects a circulation of the gasoline/alcohol mixture in the tank thereby avoiding or preventing a separation of the fuel into its components. To achieve such end, the capacity of the fuel pump must be somewhat increased so that it is capable of supplying, in addition to the fuel quantity delivered to the fuel feed device, a quantity of fuel sufficient for recirculation of the mixture to the tank.

In accordance with a particular feature of the invention the return line is provided with a valve which opens when a prescribed pressure is exceeded. This valve is preferably adjusted for an opening pressure corresponding to the pressure drop or loss in the fuel line leading to the fuel feed device. It is thus ensured that the fuel feed device will first be supplied with fuel (i.e. the fuel feed device will receive priority) and that only the excess fuel quantity delivered by the fuel pump will be returned to the tank.

For a favorable and effective circulation of the gasoline/alcohol mixture present in the fuel tank, it is advantageous if outlet opening of the return line is near the bottom of the fuel tank where upon separation of the gasoline/alcohol mixture, the component consisting predominantly of alcohol will be deposited. Thus the fuel quantity flowing out of the opening of the return line will come in contact with that component and will effectively mix it with the gasoline component. Mixing is further enhanced if the outlet opening of the return line is arranged near the inlet opening of the fuel suction line and/or it is directed toward the bottom of the fuel tank.

By arranging the fuel pump within the fuel tank so as to be immersed in the fuel, the pump can be cooled easily and thus the construction of the pump becomes very simple.

For a better understanding of the invention, together with other and further objects, reference is made to the following description, taken in conjunction with the accompanying drawings, and its scope will be pointed out in the appended claims.

BRIEF DESCRIPTION OF THE DRAWING

The single FIGURE is a cross-sectional view of a fuel delivery system in accordance with the present invention.

DESCRIPTION OF THE PREFERRED EMBODIMENT

In the FIGURE a fuel tank 1, installed in an automobile, can be filled by means of a filler neck 2 provided with a cap 3. A gasoline/alcohol mixture 4 contained in the fuel tank 1 easily separates in the presence of water and at low temperatures so that essentially alcohol and water are present below a boundary line as is indicated by the dashed line and pure gasoline floats above the boundary line. Such a separation of the gasoline/alcohol mixture is unfavorable in that the fuel feed device which produces a fuel-air mixture suitable for combustion in the internal combustion engine, such as the carburetor or fuel injection device, is dependent upon the supply of a fuel with uniform properties. If such a mixture-forming device, which is designed for operation with a gasoline/alcohol mixture, receives pure gasoline or pure alcohol, it cannot provide a optimal mixture adjusted to the prevailing operating condition of the internal combustion engine.

In order to prevent a separation of the fuel components of the gasoline/alcohol mixture in the fuel tank, the fuel delivery system in accordance with the invention is provided with a fuel pump 6 immersed in the fuel 4 within the fuel tank 1. This pump conveys the fuel by way of the fuel line 7 to the fuel feed device and fuel-air mixture forming device (not shown) of the engine. In addition, a return line 8 is connected on the pressure side of the pump to return excess fuel directly to the fuel tank, thus circulating the fuel mixture. A pressure valve 9 is inserted in the return line 8 permitting the fuel quantity designated for circulation of the fuel mixture in the tank to pass only when a prescribed pressure is exceeded. The opening pressure of this valve is adjusted to correspond to the pressure loss in the fuel line 8 leading to the fuel feed device so that a return of fuel can start only when the fuel feed device is adequately provided with fuel.

As may also be seen in the figure, the outlet opening of the return line 8 is arranged near the inlet opening of the fuel suction line near the bottom of the tank. It is also directed towards the bottom of the fuel tank 1 and, in particular, towards the alcohol component which may be deposited on the bottom upon separation of the gasoline/alcohol mixture. It is thereby ensured that, particularly in the zone of the suction opening of the fuel pump, a well mixed gasoline/alcohol mixture will be present for delivery to the fuel feed device.

While there has been described what is believed to be the preferred embodiment of the invention, those skilled in the art will recognize that other and further modifications may be had thereto without departing from the spirit of the invention, and it is intended to claim all such embodiments as fall within the scope of the invention.

I claim:

1. A fuel delivery system for an internal combustion engine operated with a gasoline/alcohol fuel mixture, said system comprising:

(a) a fuel tank;

(b) a fuel pressure line for delivering fuel from said tank to said engine;

(c) a fuel pump, disposed within said fuel tank and so situated that it is immersed when fuel is present in the tank, said fuel pump having a fuel suction line with an inlet opening near the bottom of said tank for drawing fuel from the tank, said fuel pump being connected to said fuel pressure line for supplying fuel thereto under pressure, and said fuel pump having a capacity in excess of that required for running said engine; and (d) a fuel return line connected to said fuel pressure line at a point within said fuel tank for returning fuel directly to said fuel tank, said return line having an outlet opening arranged near said inlet opening at the bottom of said tank and directed towards the bottom of said tank.

2. A fuel delivery system as defined in claim 1, further comprising valve means, connected to said return line, for permitting fuel to flow through said return line into said fuel tank when the fuel pressure exceeds a prescribed value.

3. A fuel delivery system as defined in claim 2, wherein said valve means is adjusted to permit the flow of fuel through said return line when the fuel pressure corresponds to the pressure drop in the fuel line connecting said fuel pump to the engine.

* * * * *